United States Patent [19]

Phillips et al.

[11] Patent Number: 4,519,217

[45] Date of Patent: May 28, 1985

[54] SUPERMARKET ENVIRONMENTAL CONTROL SYSTEM

[75] Inventors: Parker V. Phillips, Brantford; Ness Lakdawala, St. Lambert; Michel Lecompte, Mont St. Hilaire, all of Canada

[73] Assignee: Hussmann Corporation, Bridgeton, Mo.

[21] Appl. No.: 455,572

[22] Filed: Jan. 4, 1983

[51] Int. Cl.[3] ..... F25D 17/08; A47F 3/04

[52] U.S. Cl. ..... 62/256; 62/427; 98/38.9; 165/16

[58] Field of Search ..... 62/90, 256, 427, 428, 62/442; 165/16; 98/33 R, 38 D, 38 E, 38 F

[56] References Cited

U.S. PATENT DOCUMENTS

| | | | |
|---|---|---|---|
| 1,837,797 | 12/1931 | Shipley | 62/90 |
| 2,296,741 | 9/1942 | Sanders, Jr. | 62/427 X |
| 2,975,609 | 3/1961 | Allander et al. | 62/442 X |
| 3,625,022 | 12/1971 | Johnson | 62/428 X |
| 4,118,209 | 10/1978 | Exler et al. | 62/90 X |
| 4,124,998 | 11/1978 | Swiderski | 62/442 |
| 4,142,574 | 3/1979 | Shavit | 165/16 |
| 4,210,278 | 7/1980 | Obler | 165/16 X |

*Primary Examiner*—William E. Tapolcai
*Attorney, Agent, or Firm*—Richard G. Heywood

[57] ABSTRACT

An air temperature regulating or conditioning control apparatus for use in a space having one or more refrigerated display fixtures. The fixtures have an open refrigerated display zone separated from the conditioned room space by one or more planes (curtains) of refrigerated air substantially lower in temperature than the conditioned room space, which absorb energy from the room air adjacent these planes thereby causing it to be cooled. The apparatus comprises a housing having a return air chamber and a make-up air chamber isolated from the return air chamber. Each of these parallel chambers has an outlet connected to a mixing compartment for mixing the conditioned air received from both chambers. An air moving means is connected to the mixing compartment for displacing the mixed conditioned air through air flow convection ducts back into the space. Each of the chambers further has an air intake or inlet, a filter section and a cooling section. The inlet of the return air chamber is supplied primarily with air cooled by the refrigerated display fixtures. The room space is maintained at a substantially constant temperature throughout unaffected by the refrigeration effect of the display fixtures upon the room space air.

9 Claims, 2 Drawing Figures

SUPERMARKET ENVIRONMENTAL CONTROL SYSTEM

BACKGROUND OF INVENTION (a) Field of the Invention

The present invention relates to an air temperature conditioning control apparatus for controlling environmental conditions within a supermarket or such commercial store having large refrigeration requirements, and more specifically to the control of latent loads occurring in such stores and imposed upon open refrigerated display fixtures. The fixtures have open refrigerated display zones separated from the conditioned room space by one or more planes (curtains) of refrigerated air, which is substantially lower in temperature than the conditioned room space and which absorb energy from the room air adjacent these planes causing the room air to be cooled. The apparatus of the invention comprises an air handling housing having a return air chamber and a make-up air chamber isolated from the return air chamber. Each of the chambers has an outlet connected to a mixing compartment for mixing the conditioned air from the chambers at their outlets. Air moving means is connected to the mixing compartment for displacing the conditioned air, via convection ducts, back into the space. Each of the chambers further has an inlet, a filter section and a cooling section. The inlet of the return air chamber is supplied primarily with air cooled by the refrigerated display fixtures. The space is maintained at a substantially constant temperature throughout and is substantially unaffected by air cooled by the refrigerated fixtures. In other words, the refrigerating effect of the display fixtures upon the room air being returned to the air handling package constitutes the primary air tempering or cooling means in the entire system, but the refrigerated fixtures have no direct effect upon the room space in which they are located.

(b) Description of Prior Art

It is a well known fact that environmental control in a supermarket is affected by forces and conditions that do not normally occur in any other commercial, industrial or residential structure. These are the forces and conditions imposed on the space by the refrigeration equipment inherent in any modern supermarket. For example, a 25,000 square foot supermarket may have open display refrigeration fixtures requiring a refrigeration capacity of as much as 50 tons (600,000 BTU/HR) with a range of evaporator temperatures from −35° F. to +25° F. This inexorable cooling force exists without regard to the needs of the conditioned space. As a result, unless special emphasis is given to design of the environmental control apparatus and system, the conditioned space experiences a wide variety of undesirable conditions such as cold aisles, over cooling in areas of heavy display case concentrations, under cooling (warm spots) in areas where there are no display fixtures, extreme stratification of air (the temperature gradient between floor and ceiling may be as much as 35° F.), and control of the environment's latent heat loads is near impossible. The specific moisture content of the air in the conditioned space is usually a function of outside air conditions, but relative humidity varies considerably because of variations in air temperature throughout the space.

Refrigeration compressors in a supermarket account for approximately 44% of the total supermarket energy consumption at design conditions. Increases in dry bulb temperature above design conditions have no affect on the compressor load and its energy usage as long as the wet bulb in the conditioned space remains constant. Conversely, with constant dry bulb temperatures, variations in wet bulb temperature (and therefore relative humidity) have a dramatic affect on the compressor's load, and therefore the energy consumed. Increases in the wet bulb temperature result in load and energy increases, while decreases in wet bulb temperature result in decreases in load and energy consumption.

The refrigeration effect induced by the display fixtures upon the environment must therefore be controlled. This, however, must influence the design of the building, the calculation of environmental loads, both cooling and heating, and design of the apparatus. In the example of the 600,000 BTU/HR refrigeration load, approximately 75% or 450,000 BTU/HR could represent a direct refrigerating effect by the display fixtures upon the conditioned space. This massive refrigerating effect is a potential source of cooling that can be credited against the space environmental cooling loads providing steps are taken in design of the system, and apparatus to absorb, treat and redistribute this refrigerating effect. Thus, absorption and use of this refrigerating effect produces conditions which dictate very special design considerations in the requirements of the air cooling and conditioning apparatus.

The refrigerating effect of the supermarket display fixtures has an unusual affect upon the environment's latent heat loads. There are, basically, two components of latent load which must be considered; the internal latent load derived from sources within the conditioned space such as people and appliances (coffee urns, steam tables, etc.), and ventilation latent load which is a function of the fresh make-up air supplied to the conditioned space from the outside or ambient environment. The latent component of the refrigerating effect from the display fixtures acts directly upon the internal latent load. This is to say that that portion of the internal latent heat load equal to the latent component of the refrigerating effect is directly absorbed by the display fixture cooling coils. This, again, produces an unusual condition which must be taken into consideration in design of the conditioning apparatus. Since the internal latent load is acted upon directly by the display fixtures, the ventilation latent load is left as a dominant latent load and in the interest of energy efficiency, this too dictates the need for special consideration in the design of the conditioning apparatus.

Recovery of the heat rejection from the supermarket's refrigeration systems is likewise important, both to the control of environmental conditions and to the control of energy input. Heat reclaimer systems, per se, are well known in the industry and in practice have been applied to the recirculated supply air stream, downstream of the air conditioning cooling coil in the apparatus where waste heat from the refrigeration systems can be employed as a reheat medium for humidity control, when required, as well as a heat source for store heating during periods when heating, as opposed to air conditioning, is required for environmental control.

In this position in the conventional conditioning control apparatus, the heat reclaim coil is exposed to extreme variations in entering air temperature resulting from the mixing of outside make-up air with return air from the conditioned space. This, together with extreme variations in display fixture loads, which occur with normal changes in atmospheric conditions, create serious operational problems in the refrigeration systems whereby the condensing temperatures of the refrigeration systems are reduced below satisfactory operating levels or massive quantities of refrigerant are required for condensing temperature/pressure control in the systems.

SUMMARY OF THE INVENTION

It is a feature of the present invention to provide an air temperature conditioning control apparatus for supermarkets that will absorb, treat, and re-distribute the refrigerating effect produced on the conditioned space by the supermarket's refrigerated open display fixtures, thus substantially reducing or eliminating temperature variations and gradients throughout the conditioned space.

It is a further feature of this invention to provide an air conditioning control apparatus that will prevent stratification of air in supermarkets.

Still another feature of the present invention is to provide an air temperature control apparatus that will provide improved control of latent heat loads in supermarkets.

It is a further feature of the present invention to provide an air temperature control apparatus whereby control of the environment will reduce latent heat loads on the supermarket's refrigerated open display fixtures.

A further feature of this invention is to control the energy input to a supermarket by providing superior environmental air temperature regulation.

Another feature of this invention is to reduce the environmental cooling load by absorption, treatment and distribution of the refrigerating effect of the supermarket's refrigerated open display fixtures.

Still another feature of the present invention is to reduce the supermarket's energy consumption by absorbing, treating, and re-distributing the refrigerating effect produced by the supermarket's refrigerated display fixtures.

A further feature of the present invention is to provide an air control apparatus for absorption, treatment and distribution of the refrigerating effect of the supermarket's refrigerated open display fixtures.

Still another feature of the present invention is to provide an air control apparatus in which the recirculated return air is treated separately from the outside make-up air.

A further feature of the invention is to provide an air conditioning control apparatus in which outside make-up air is treated separately from return air as a means of reducing moisture input to the supermarket.

It is another feature of the present invention to provide an air conditioning control apparatus in which outside make-up air is treated separately from return air to allow more efficient design of the heat transfer surfaces.

Still another feature of this invention is to provide an air conditioning control apparatus in which the store return air and outside air components of the load are treated separately for the purpose of reducing operating costs.

A further feature of the present invention is to provide an air conditioning control apparatus having a heat transfer surface for utilizing waste heat from the supermarket's refrigeration systems for the purpose of reheating the system's supply air to control humidity and facilitate moisture removal.

Another feature of the invention is to provide an air conditioning control apparatus having heat reclaim means for the purpose of transferring waste heat from the supermarket's refrigeration systems to the air as the primary space heating source.

Still another feature of the invention is to provide an air conditioning control apparatus having a heat transfer surface for utilizing the waste heat from the supermarket's refrigeration systems only to condition the return store air.

According to the above features, from a broad aspect, the present invention provides an air temperature control apparatus for use in a space having one or more open display refrigeration fixtures. The fixtures have an open refrigerated display zone separated from the conditioned room space by one or more planes (curtains) of refrigerated air, which are substantially lower in temperature than the conditioned room space and which absorb energy from the room air adjacent these planes thereby causing it to be cooled. The apparatus comprises a housing having a return air chamber and a make-up air chamber in parallel by-pass relation. Each of the chambers has an outlet connected to a mixing compartment for mixing the conditioned air from both chambers. Air moving means are connected to the mixing compartment for displacing the conditioned air, via convection duct means, back into the space. Each of the chambers further has an inlet, a filter section and a cooling section. The inlet of the return air chamber is supplied primarily with air cooled by the open display refrigeration fixtures but the space is maintained at a substantially constant temperature throughout and is not directly affected by the cooling effect of the display fixtures.

BRIEF DESCRIPTION OF DRAWINGS

These and other objects of the present invention will become apparent from the following description of an example of the preferred embodiment as illustrated by the accompanying drawings, in which.

DESCRIPTION OF THE PREFERRED EMBODIMENT

Figure 1:
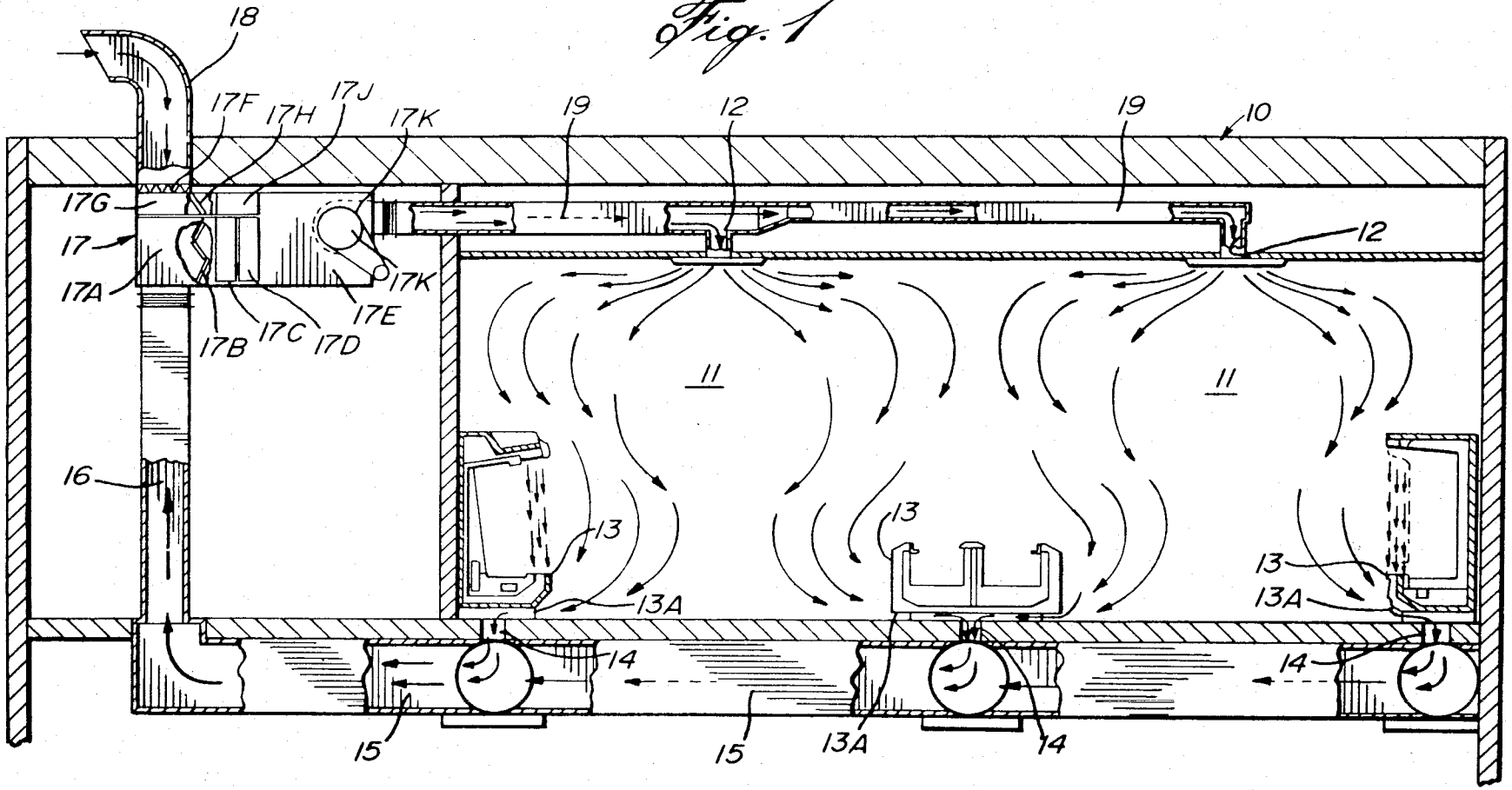
FIG. 1 is a schematic cross-sectional view of a supermarket area having refrigeration fixtures therein.
Figure 2:
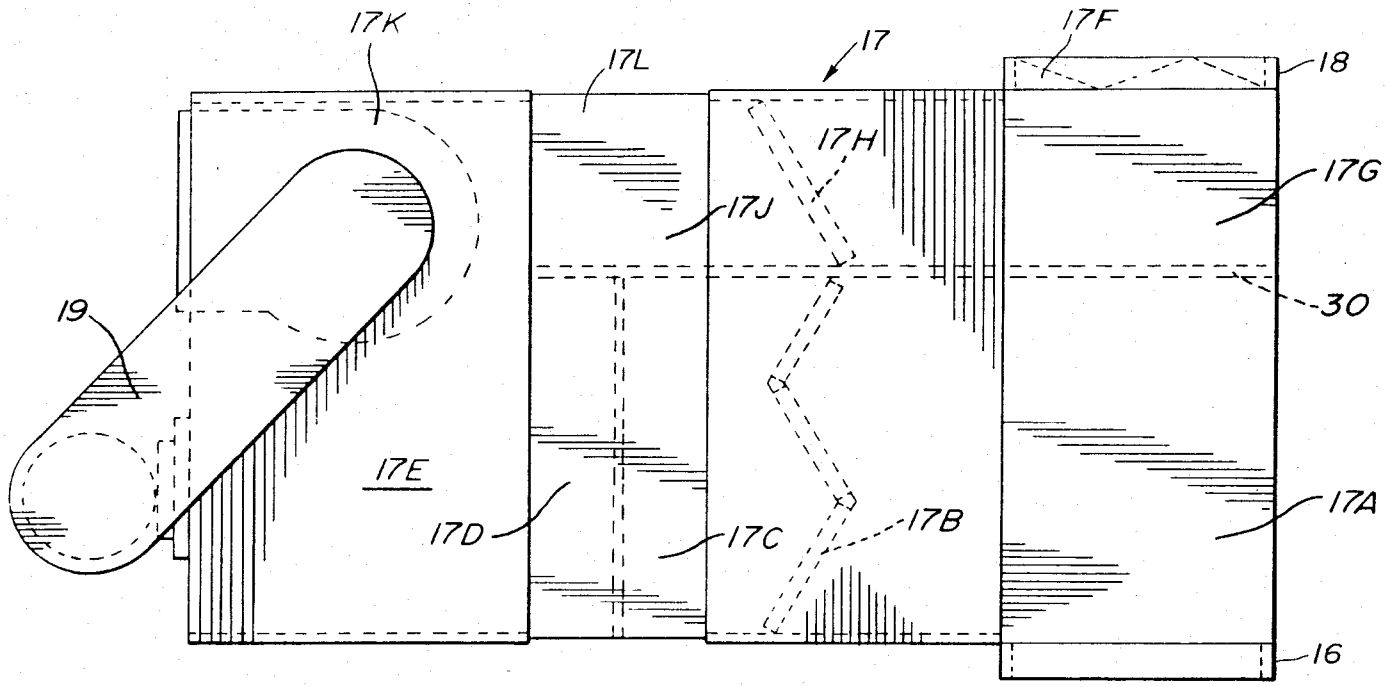
FIG. 2 is a side elevational view showing the compartments and sections of the air control apparatus taken from the side opposite to that shown in FIG. 1.

Referring now to FIGS. 1 and 2, there is shown a building structure 10 intended for occupancy as a supermarket. A conditioned space 11, which shall be referred to as "the sales area", is supplied with temperature regulated or conditioned air via one or more supply air inlets 12 located in, but not restricted to the ceiling. It will be understood that the word "conditioning" is used in the broad sense of temperature regulation and is not restricted to air refrigeration. A plurality of refrigerated open display fixtures 13 are provided in the sales area space 11. The fixtures 13 have an open, ventilated base 13A to allow flow of air through the splash guards, and under the fixture. Return air openings 14 are located under the fixtures for communicating air between the air space under the fixtures and a return air duct 15.

The return air duct 15 is strategically positioned in relationship with the display fixtures 13 and return air openings 14 to allow flow of cool return air under the display fixtures 13 and into the return air duct 15 via the return air openings 14. A return air riser 16 is preferably located outside the sales area 11 and connects the return air duct 15 to an air treatment or climatic conditioning control apparatus 17.

The apparatus 17 is shown in detail in FIG. 2 and has a return air plenum 17A, a return air filter bank 17B, a return air conditioning coil or cooling surface 17C, a heat reclaim coil or surface 17D, make-up air control dampers 17F which establishes the intake air flow proportion from the ambient, outdoor environment, a make-up air plenum 17G, a make-up air filter bank 17H, make up air conditioning coil which has a primary cooling surface 17J and a secondary cooling surface 17L. Both the return air compartment and make-up air compartment are isolated from one another by a horizontal dividing wall or partition 30 and they both feed a mixing box 17E. A primary air moving means 17K communicates with the mixing box. A supply air duct 19 with its concommitant branches communicate between the air moving means 17K and the supply air inlets 12.

In operation, supply air enters the sales area through the supply air inlets 12 in sufficient quantity and at conditions of temperature and moisture content to satisfy both the RSH (room sensible heat) and RLH (room latent heat) loads. This can be calculated as variations of the equations:

$$tsa = trm - \left(\frac{RSH}{1.08\ (CFMsa)}\right)$$

and $$Wsa = Wrm - \left(\frac{RLH}{.68\ (CFMsa)}\right)$$

where:
tsa = temperature supply air
trm = temperature room
RSH = room sensible heat
1.08 = constant
CFMsa = supply air volume
Wsa = specific moisture supply air
Wrm = specific moisture room air
RLH = reclaim latent heat
.68 = constant In the sales area, heat from transmission, solar gain and internal loads such as lighting, people, etc., is continuously absorbed by the room air which is to be finally conditioned or treated in the air handler apparatus 17 to maintain room design conditions.

The refrigerated display fixtures 13 absorb some heat from the room air in their proximity. However, the greatest portion of this heat exchange or the refrigeration effect upon the room air occurs at the open front of the fixtures and the air so cooled becomes more dense and falls to the floor in front of the fixtures.

This cold air from the sales area is drawn in through the open fixture splash guard and base 13A, into the return air opening 14, and into the return air duct 15. In so doing, the room air cooled by the display fixture 13 is drawn into the return air duct 15 and the refrigerating effect of the display fixture 13 is absorbed into the conditioning cycle of the system. The affect of the refrigerating effect of the refrigerated cases can be calculated as variations of the equations:

$$tra = trm - \left(\frac{RSC}{1.08\ CFMra}\right) \text{ and}$$

$$Wra = Wrm - \left(\frac{RLC}{.68\ CFMra}\right) \text{ or}$$

where:
tra = temperature, return air
trm = temperature, room
RSC = refrigeration sensible credit
1.08 = constant
CFMra = volume return air
Wra = specific moisture, return air
Wrm = specific moisture, room air
RLC = refrigeration latent credit
0.68 = constant Recirculated air flow continues through return air duct 15 and return air riser 16 to the air conditioning control apparatus 17 where it enters through the return air plenum 17A, passes through the return air filter bank 17B and across the return air heat transfer or air cooling surface 17C. Since the desired environmental control conditions of the supply air have already been established, this air must enter the mixing compartment or box 17E at supply air conditions.

If cooling is required in the sales area, heat will be removed by the return air heat transfer surface 17C. If heating is required in the sales area, the return air will be conditioned as it passes through the return air heat reclaim coil 17D where waste heat from the supermarket's refrigeration system is added to the return air before it passes into the mixing compartment 17E.

The total heat load to be removed from the return air in the return air heat transfer surface 17C can now be expressed as:

$$RATH = 4.45 \times CFMra \times (h_2 - h_1)$$

where:
RATH = return air total heat
4.45 = constant
CFMra = return air volume C.F.M.
$h_2$ = enthalpy of return air
$h_1$ = enthalpy of supply air.

In every building there are air losses through doors, windows, exhaust fans, combustion heating stacks, etc. There must be provided a sufficient quantity of fresh make up air (ventilation air) to offset these losses.

Make-up air enters the system through the make-up air inlet and duct 18 to the air conditioning control apparatus 17 where it enters through the make-up air damper 17F. The position of the make-up air damper 17F is twofold: it is used to proportion and fix the maximum volume of make-up air entering the building according to established design conditions and, since the air losses from the building are vastly reduced during periods of non-occupancy, the make-up air damper is used to substantially reduce the make-up air volume or to completely close it off during these periods. Make-up air enters through the make-up air dampers 17F, make-up air plenum 17G, make-up air filter bank 17H and across the make-up air heat transfer or air cooling surface 17J and 17L. When cooling is required, make-up air must also enter the mixing compartment 17E at the calculated supply air conditions, and heat will be removed by the make-up air heat transfer surfaces 17J and 17L.

The total heat load to be removed from the make-up air by the make-up air cooling coil 17J alone or with secondary coil 17L can now be expressed as:

$$MATH = 4.45 \times CFMma \times (h_4 - h_3)$$

where:

MATH = make-up air total heat
4.45 = constant
CFMma = make-up air volume – C.F.M.
$h_4$ = enthalpy make-up air
$h_3$ = enthalpy of supply air Make-up air now flows into mixing box 17E and through the primary air moving means 17K where it is mixed with conditioned air from the main return air flow passing through the air cooling surface 17C and heat reclaim coil 17D, and the mixed conditioned air flows into the supply air duct 19, and supply air duct branches to the supply air inlet diffusers 12 at which point the cycle commences again.

The air treatment control apparatus is regulated by any well known controller which will have two or more stages of air cooling control, two or more stages of heat reclaim control, two or more stages of auxiliary heat control, 1 stage of humidity control, a clock to regulate non-occupancy hours and during periods of non-occupancy will reduce or close off make-up air dampers, re-set sales area space temperatures to intermediate values and allow the refrigerating effect of display fixtures to adjust store temperature to that level for energy efficiency and cycle the air handler blower as required to maintain a new set-point.

In sequence of operation, the make-up air heat transfer surface 17J alone or in combination with surface 17L represents the first stage of cooling, the return air heat transfer surface 17C represents the second stage of cooling, the make-up air heat transfer surface 17J and/or the air cooling coil 17C alone or with the heat reclaim coil 17D represent dehumidification, the heat reclaim coil 17D represents first or first and second stages of heating, and auxiliary heat, if required, may be located downstream of the heat reclaim coil 17D or separately from the apparatus. The use of conventional thermostatic and humistatic control sensors located in the room space to be controlled will be clearly understood by those skilled in the art, and these operate in their respective conventional functions to cool, heat and dehumidify recirculated room air. Similarly, the use of conventional dewpoint and thermostatic sensors located upstream and downstream of the make-up air units 17H and 17L will also be clearly recognized by those skilled in the art as being the essential controller means for the tempering of make-up air to cool and/or dehumidify it independently prior to mixing with recirculated room air.

We claim:

1. An air temperature control apparatus for conditioning an enclosed space having at least one refrigerated display fixture having an open display zone separated from the conditioned space by at least one plane of refrigerated air that is substantially lower in temperature than the air temperature throughout the enclosed space and which imposes a continuous refrigeration effect thereon in the form of cooling the space air adjacent to said plane and inducing a downward flow of said cooled space air adjacent to said refrigerated fixture, said apparatus comprising return air inlet means located under said refrigerated fixture for receiving said cooled space air, a housing having a return air chamber and a make-up air chamber isolated from each other, said return air chamber having an inlet in communication with said return air inlet means for being supplied with the air from the conditioned space that is cooled by said refrigeration effect, said make-up air chamber having an inlet being supplied by ambient air from outside said enclosed space, separate air treatment means in each of said chambers for separately conditioning the respective air flow therethrough, each of said chambers having an outlet connected to a mixing compartment for receiving and mixing the separately conditioned air from the respective return air and make-up air chambers and including air moving means for displacing said mixed conditioned air back into said enclosed space.

2. An air temperature control apparatus according to claim 1, in which said air treatment means in each of said chambers includes at least one air filter section and at least one cooling section.

3. The air treatment control apparatus according to claim 2 wherein said make-up air chamber is provided with damper means in said inlet opening to selectively adjust the size of said opening between a closed position and an open position to control the quantity of fresh ambient air admitted to said make-up air chamber.

4. The air treatment control apparatus according to claim 3 wherein said make-up air chamber is further provided with a secondary cooling section to adjust the temperature conditioning of fresh air entering said housing through said inlet opening.

5. The air treatment control apparatus according to claim 2 wherein said return air chamber is further provided with a reheat section located between said cooling section and said mixing compartment for tempering said conditioned air upstream of said mixing compartment.

6. The air treatment control apparatus according to claim 1, wherein said return air inlet means comprise return air ducts communicating with said return air chamber and being located in the floor of said enclosed space adjacent said refrigerated display fixture to substantially directly receive air cooled by said fixture, whereby the enclosed space is maintained at a substantially constant temperature throughout and unaffected by the refrigeration effect imposed by said refrigerated display fixture.

7. The air treatment control apparatus according to claim 6 wherein said refrigerated display fixture is provided with a cooling coil subjected to both an internal display fixture load and an external space load, said space load being substantially isolated from said cooling coils by planes of refrigerated and space air whereby to maintain said room space at substantially constant temperature throughout.

8. Air temperature control apparatus for conditioning an enclosed space having refrigeration means imposing a continuous refrigeration effect on the environment of said space, said apparatus comprising first air flow passage means having an inlet immediately adjacent to said refrigeration means for receiving from said enclosed space return air that has been cooled by the refrigeration effect imposed by said refrigeration means, second air flow passage means having an inlet for receiving fresh make-up air from the ambient externally of said space, said second air flow passage means being the only air inlet means for conducting fresh make-up air into said apparatus, said first and second passage means being in parallel, by-pass air flow relationship with each other and each of said first and second passage means housing separate temperature regulating means for conditioning the respective air flow therethrough, an air mixing compartment for receiving and mixing the separately conditioned air from said first and second passage means, and air moving means for circulating the mixed conditioned air through the enclosed space environment.

9. The air temperature control apparatus according to claim 8, in which said enclosed space comprises a food store and said refrigeration means comprises a multiplicity of refrigerated display fixtures, some of which have open display areas separated from said conditioned space by planes of refrigerated air at temperatures lower than the air temperature of said enclosed space, said planes of air inducing said refrigeration effect upon space air adjacent thereto, and said inlet to said first air flow passage means including air return means located under said fixtures for receiving said space air cooled by the refrigeration effect, and said return air and make-up air being continuously and independently conditioned in said respective chambers and then being mixed for discharge into said enclosed space to maintain a substantially uniform temperature/humidity condition throughout said enclosed space.

* * * * *